US006754060B2

(12) United States Patent
Kauffman

(10) Patent No.: US 6,754,060 B2
(45) Date of Patent: Jun. 22, 2004

(54) PROTECTIVE DEVICE

(76) Inventor: George M. Kauffman, 14 Abigail Dr., Hudson, MA (US) 01749

( * ) Notice: Subject to any disclaimer, the term of this patent is extended or adjusted under 35 U.S.C. 154(b) by 166 days.

(21) Appl. No.: 09/882,271

(22) Filed: Jun. 15, 2001

(65) Prior Publication Data

US 2002/0021541 A1 Feb. 21, 2002

Related U.S. Application Data

(60) Provisional application No. 60/216,203, filed on Jul. 6, 2000.

(51) Int. Cl.[7] ..... H01C 7/12

(52) U.S. Cl. ..... 361/119; 361/117; 361/120

(58) Field of Search ..... 361/119, 120, 361/117

(56) References Cited

U.S. PATENT DOCUMENTS 4,544,984 A * 10/1985 Kawanami et al. ..... 361/119
5,768,084 A * 6/1998 Chaudhry et al. ..... 361/120
5,953,195 A * 9/1999 Pagliuca ..... 361/120
6,101,080 A 8/2000 Kühne ..... 361/119

* cited by examiner

*Primary Examiner*—Brian Sircus
*Assistant Examiner*—James A Demakis
(74) *Attorney, Agent, or Firm*—Kriegsman & Kriegsman

(57) ABSTRACT

A protective device for an RF cable comprises in one embodiment an outer conductor having a main body section, a first connector and a second connector. The main body section has a cylindrically shaped inner sidewall and includes a first end and a second end. The first connector extends out from the first end of the main body section. The second connector extends out from the second end of the main body section. An inner conductor is axially disposed within the outer conductor and extends through the main body section into the first and second connector interface. Insulators are provided for mechanically supporting and electrically insulating the inner conductor from the outer conductor. A gas discharge tube (GDT) is disposed inside the main body section between the cylindrically shaped inner sidewall and the inner conductor. A spring of electrically conductive material is disposed inside the main body section between the GDT and the main body section in contact with the cylindrically shaped sidewall and the GDT and is under compression.

26 Claims, 8 Drawing Sheets

PROTECTIVE DEVICE

CROSS-REFERENCE TO RELATED APPLICATIONS

This application claims the benefit of provisional U.S. patent application Ser. No. 60/216,203 filed on Jul. 6, 2000.

BACKGROUND OF THE INVENTION

The present invention relates to protective devices for use in deflecting or reducing short duration, large current, artificially or naturally created electromagnetic impulses traveling along a radio frequency (RF) cable, while allowing desired RF signals to pass through.

Short duration, large current, artificially created electromagnetic impulses, such as produced by motors, switches or certain types of electrical circuits or naturally created electromagnetic impulses such as produced by lighting and transmitted through RF cables may damage or even destroy the equipment which may be connected to these cables.

In the past, such equipment has been protected by devices which eliminate or deflect such impulses.

One such device comprises an elongated cylindrical housing having connectors at each end which serves as an outer conductor, an elongated pin axially disposed within the housing which serves as an inner conductor, insulators for electrically separating the outer conductor from the inner conductor and a gas discharge tube (GDT) electrically coupled between the outer conductor and the inner conductor. The GDT is mounted in a hole formed in the sidewall of the housing and is pushed down in the hole into electrical contact with the inner conductor by a spring and an end cap. This arrangement for mounting the GDT inside the protective device is costly and not very satisfactory.

In U.S. Pat. No. 4,359,764 to Roger R. Block there is disclosed a connector for the suppression of electromagnetic impulses traveling along a radio frequency cable. Paired first and second electrical connectors are provided for being operatively interposed along the signal cable. A spacer or mounting device is provided for electrically coupling the primary conductors and secondary conductors of one connector to their counter parts in the other paired connector. A gas discharge tube having a known breakdown voltage and a known capacitance is electrically and mechanically coupled between the first and second conductors of the mounting device. The inductance of the elements comprising the mounting device are determined such that this inductance interacts with the capacitance of the gas discharge tube and other stray capacitance of the combination thereof in order to produce a characteristic impedance which is generally equal to the characteristic impedance of the radio frequency signal cable, whereby the suppressor will dissipate electrical surges while representing low standing wave ratio to radio frequency energy being transmitted along the radio frequency signal cable.

In U.S. Pat. No. 4,409,637 to Roger R. Block there is disclosed a connector for the suppression of electromagnetic impulses traveling along a radio frequency transmission line. Paired first and second electrical connectors are provided for being operatively interposed along the transmission line. First and second conductors are provided for electrically coupling the primary conductors and secondary conductor of one connector to their counterparts in the other paired connector. A discharge device or tube having a known breakdown voltage and a known capacitance is coupled between the first and second conductors. A capacitor is coupled in series with the first conductor for blocking the flow of dc energy there through. The inductance of the first and second conductors are determined such that this inductance interacts with the capacitance of the discharge device, and the capacitor and other stray capacitance of the combination thereof in order to product a desired characteristic impedance, which is generally preferred to be equal to the characteristic impedance of the radio frequency transmission line, whereby the suppressor will dissipate electrical surges while representing a low standing wave ratio to radio frequency energy being transmitted along the line. In an alternate embodiment, a ground plane is provided for reducing the effective size of a balanced line embodiment thereof.

In U.S. Pat. No. 4,554,608 to Roger R. Block there is disclosed a connector for the suppression of electromagnetic impulses traveling along a radio frequency transmission line. Paired first and second electrical connectors are provided for being operatively interposed along the transmission line. First and second conductors are provided for electrically coupling of the primary conductors and secondary conductors of one connector to their counterparts in the other paired connector. A discharge device or tube having a known breakdown voltage and a known capacitance is coupled between the first and second conductors. First and second capacitors are coupled in series respectively with the first and second conductors for blocking the flow of dc energy there through. The inductance of the first and second conductors are determined such that this inductance interacts with the capacitance of the discharge device, and the two capacitors and other stray capacitance of the combination thereof in order to produce a desired characteristic impedance, which is generally preferred to be equal to the characteristic impedance of the radio frequency transmission line, whereby the suppressor will dissipate electrical surges while representing a low standing wave ratio to radio frequency energy being transmitted along the line. The two capacitors prevent the flow of dc energy along the transmission line in order to protect the electronic equipment connected thereto.

In an alternate embodiment, a second capacitor and discharge device are utilized in order to provide additional differentiation and clamping of the impulse signal. An embodiment is also disclosed for inserting and removing a control signal along the center conductor.

In U.S. Pat. No. 5,764,114 to Gregor Kühne there is disclosed an electromagnetic pulse filter which can be used simultaneously for a plurality of frequency bands. The filter includes a housing mounted in the outer conductor and a $\lambda/4$ short-circuiting conductor, which is connected in an electrically conductive fashion to the inner conductor of a coaxial line and is connected in an electrically conductive fashion to the end face of a housing. Arranged between the housing and the short-circuiting conductor is at least one sleeve which is connected to the latter in a conductive fashion. The length of the short circuiting line corresponds to the $\lambda/4$ length of the lowest frequency band transmitted. Considered together, the sleeves produce a number of cavity resonators which are connected in series and are tuned with their length to various midband frequencies. It is directly possible by means of such cavity resonators connected in series to transmit a plurality of frequency bands, and thus to protect terminals against damaging current surges.

In U.S. Pat. No. 6,101,080 to Gregor Kühne there is disclosed a de-coupled EMP-charge eliminator device in a co-axial cable, with the charge eliminator component in electric contact with conductor leading to the internal conductor of the co-axial lead, and with a housing attached to an external conductor, whereby a concentrated capacitor is inserted, in parallel, between the housing and the conductor, and the charge eliminator is placed between the capacitor and the housing and that this becomes, via the capacitance of the capacitor, a RF-short circuit breaker so that conductor acts as a lamda/4 short-circuit conductor.

SUMMARY OF THE INVENTION

It is an object of this invention to provide a new and improved protective device for deflecting or reducing short duration, large current electromagnetic impulses traveling along an RF cable while allowing desired RF signals to pass through.

It is another object of this invention to provide a protective device as set forth above and having an outer conductor, an inner conductor and a protective element between the outer conductor and the inner conductor and wherein the protective element is mounted within the protective device in a new and novel manner.

In furtherance of the objects broadly set forth above there is provided a protective device for suppressing short duration, large current, electromagnetic impulses which may occur along a RF cable, said protective device including among other things in accordance with one aspect of the invention, an outer conductor and an inner conductor, said outer conductor comprising a main body section, a first connector and a second connector, said main body section having a first end and a second end, said first connector extending out from the first end of the main body section, said main body section comprising a housing having an inner sidewall, said second connector being mechanically mounted on and extending out from the second end of the main body section, an inner conductor axially disposed within the outer conductor, insulators for mechanically supporting and electrically insulating the inner conductor from the outer conductor, a protective element disposed inside the main body section between the inner sidewall in the main body section and the inner conductor, and a spring of electrically conductive material disposed inside the main body section between the protective element and the main body section in contact with said sidewall and said protective element, said spring and said protective element providing a current path from the inner conductor through the protective element to the inner sidewall.

According to another aspect of the invention the impedance through the length of the device is controlled to optimize RF performance.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein the reference numerals represent like parts.

DETAILED DESCRIPTION OF PREFERRED EMBODIMENTS

Figure 1:
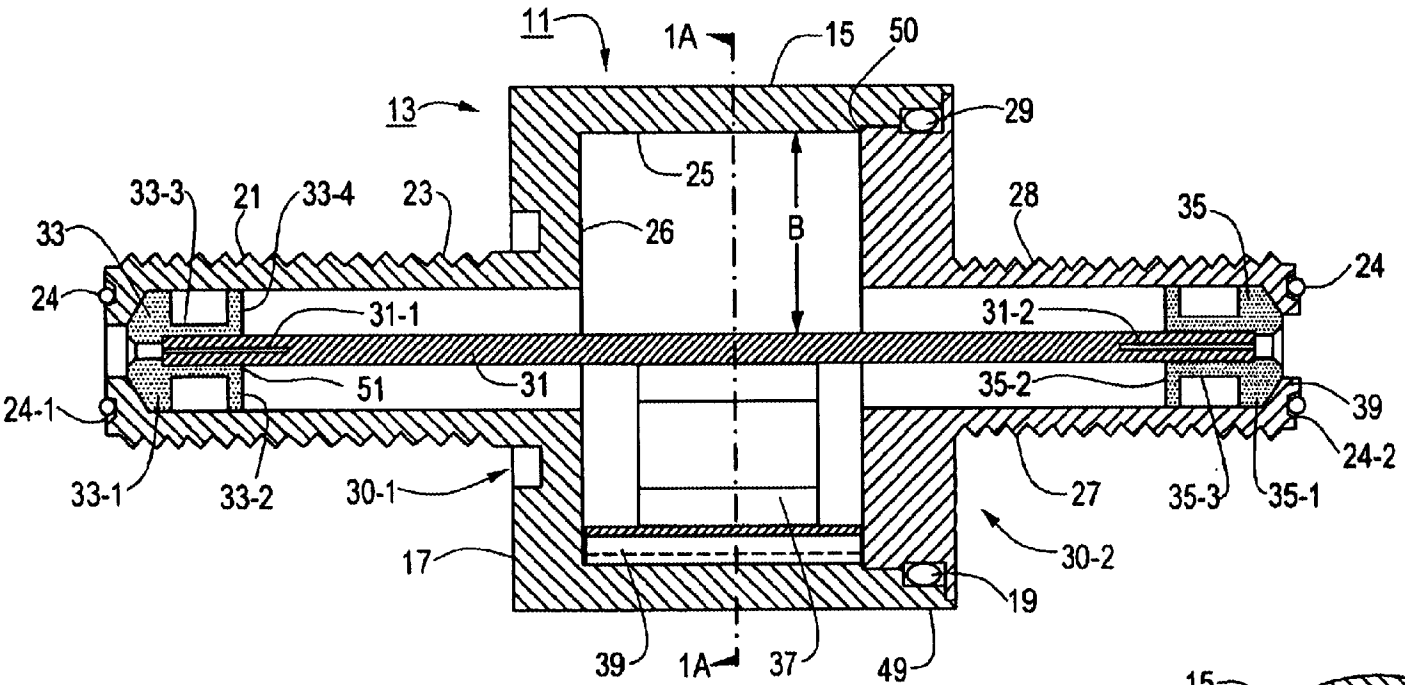
FIG. 1 is a section view of one embodiment of a protective device constructed according to this invention.
Figure 2:
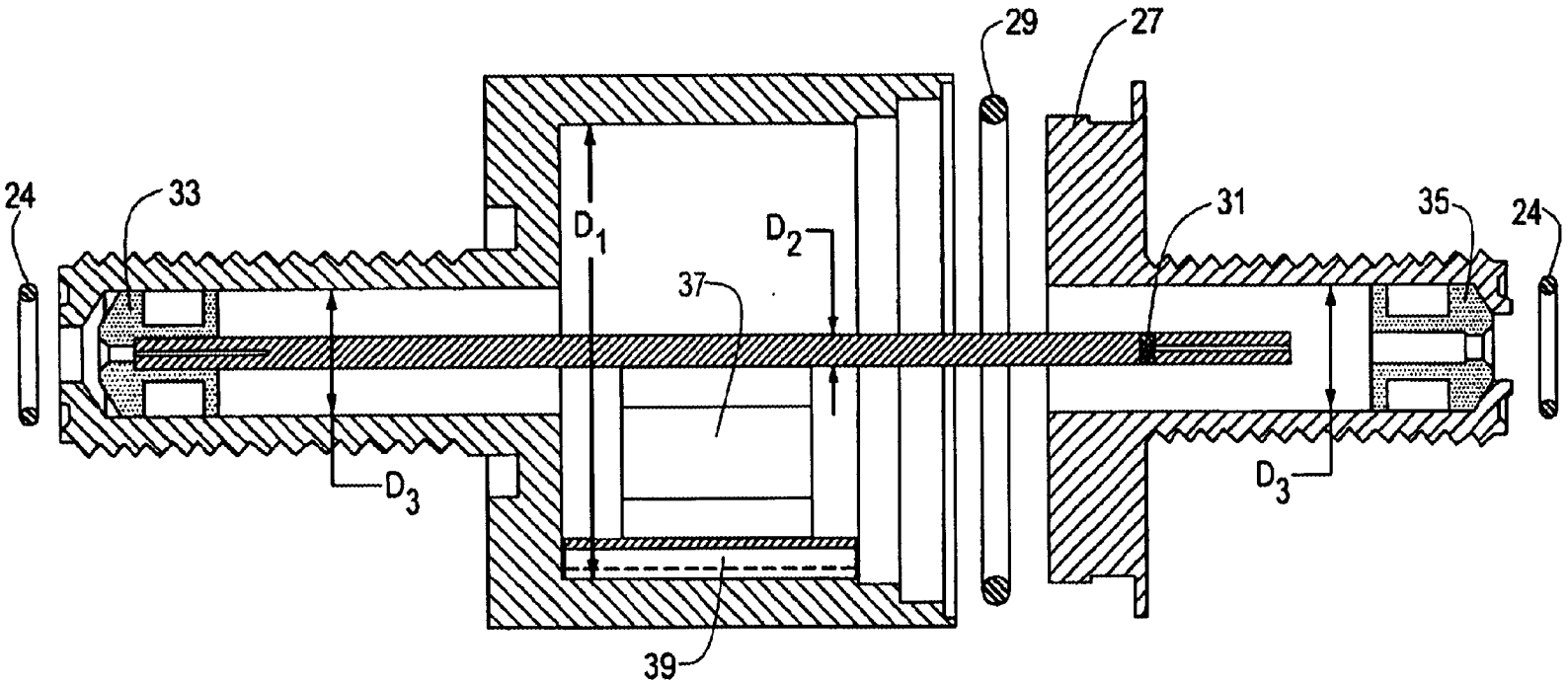
FIG. 2 is a partially exploded section view of the protective device shown in FIG. 1.
Figure 3:
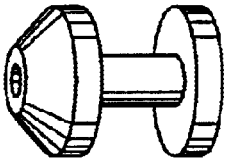
FIG. 3 is a perspective view of one of the insulators shown in the protective device in FIG. 1.
Figure 5:
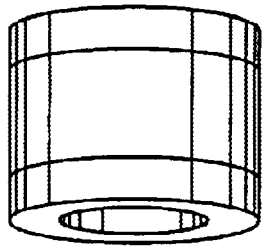
FIG. 5 is a perspective view of the GDT shown in the protective device in FIG. 1.
Figure 4A:
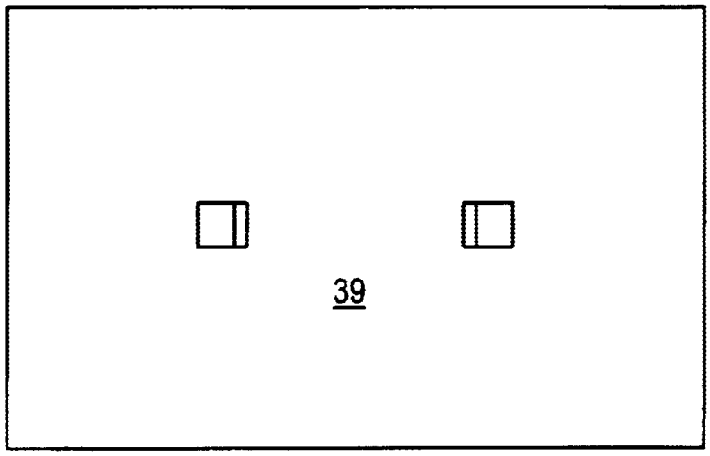
FIGS. 4A, 4B and 4C are plan, end and side views, respectively, of the spring shown in the protective device in FIG. 1.
Figure 4B:
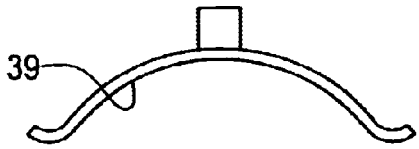
Figure 4C:
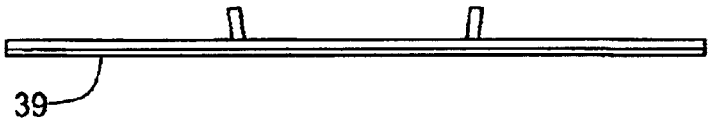

Referring now to the drawings, and first to FIGS. 1 through 6, there is shown in FIGS. 1 and 2 a first embodiment of a protective device constructed according to the teachings of the present invention for use in deflecting or reducing short duration, large current, artificially or naturally created electromagnetic pulses which may occur along a RF cable, the protective device being identified by reference numeral 11.

Protective device 11 comprises an outer conductor 13 having a main body section 15 which includes a first end 17 and a second end 19. Outer conductor 13 further includes a first connector 21. First connector 21 is an elongated generally cylindrically shaped member which is threaded on its outer surface 23 and is integrally formed with main body section 15. A gasket 24 is seated in a recess 24-1 at the outer end of first connector 21. Outer conductor 13 is made of a suitable conductive material such as brass. Main body section 15 is in the general form of a cylindrical housing open at record end 17 and has an inner sidewall 25 that is cylindrically shaped and an inner end wall 26 that is annularly shaped. Outer conductor 13 further includes a second connector 27. Second connector 27, which constitutes an end plug, is press fit onto second end 19 of main body section 15. Second connector 27 includes an elongated generally cylindrically shaped member which is threaded on its outer surface 28. Second connector 27 is made of a suitable conductive material such as brass. An O-ring 29 is sandwiched between main body section 15 and end plug 27. Another gasket 24 is seated in a recess 24-2 at the outer end of second connector 27.

Main body section 15 and first connector 21 together define the primary portion 30-1 of outer conductor 13 while second connector 27 defines the secondary portion 30-2 of outer conductor 13.

An inner conductor 31 is disposed along the longitudinal axis of outer conductor 13 and extends through main body section into first connector 21 and into second connector 27. Inner conductor 31 is in the form of an elongated pin, uniform in cross section along its length and slotted at each end 31-1 and 31-2 so that it can receive at each end a pin from a mating male connector (not shown) to which it may be connected. Inner conductor 31 is made of a bronze alloy i.e. copper alloy 510, or other suitable conductive material.

As can be seen, first and second connectors 21 and 27 are constructed as female connector interfaces; i.e. constructed to receive mating male connectors.

Figure 6:
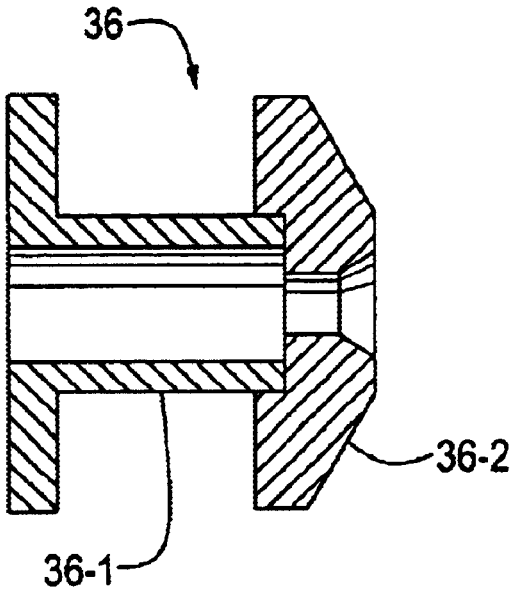
FIG. 6 is a section view of a modification of the insulator shown in FIG. 3.

A pair of spool shaped insulators 33 and 35, one insulator 33 being inside first connector 21 near its outer end 37 and the other insulator 35 being inside second connector 27 near its outer end 39, mechanically support pin 31 and electrically insulate pin 31 from outer conductor 13. Insulators 33 and 35 may be made of polycarbonate or other suitable insulative material. Insulator 33 comprises a pair of disc shaped end sections 33-1 and 33-2 disposed on either end of an elongated center section 33-3. Insulator 35 comprises a pair of disc shaped end sections 35-1 and 35-2 disposed on either end of an elongated center section 35-3. As can be seen, insulators 33 and 35 are short in that they extend only partially along the length of connectors 21 and 27, respectively rather than along the entire length of their respective connectors. Instead of being a unitary structure, the insulators may be a two piece structure as shown in FIG. 6 and identified by reference numeral 36, the two parts being identified by reference numerals 36-1 and 36-2.

A protective element is disposed inside main body section 15 between inner sidewall 25 and pin 31. In the device shown in FIG. 1, the protective element is in the form of a gas discharge tube (GDT)-37. GDT 37 may be, for example, Part Number BB-90 made by CITEL. Other types of protective elements which may be used include a Varistor or a diode.

A spring 39 of electrically conductive material is disposed inside main body section 15 between GDT 37 and main body section 15. Spring 39 is in contact with sidewall 25 and GDT 37 and is under compression. As can be appreciated, GDT 37 along with spring 39 provide a current path from pin 31 to sidewall 25. In addition, spring 39 serves to maintain GDT 37 in fixed position within main body section 15. Spring 39 is mechanically attached to GDT 37 by a pair of tabs 41 and 43, see FIGS. 4A through 4C, which extend out from body portion 45 of spring 39 and engage a depression 46 on the bottom of GDT 37.

Protective device 11 may be assembled in the following manner.

First, end gaskets 24 are installed in recesses 24-1 and 24-2. Then, O-ring 29 is slid onto second connector 27 into O-ring groove 49. Then one end 31-1 of pin 31 is inserted into the axial bore 51 at the inner end 33-4 of insulator 33. Then, insulator 33 and pin 31 are installed, insulator 33 first, into first connector 21. Then, GDT 37 is attached to spring 39 by engaging tabs 41 and 43 into depression 46 on bottom of GDT 37. Then, lifting the other end 31-2 of pin 31, spring 39 with GDT 37 attached thereto are slid into main body section 15 along inner side wall 25 underneath pin 31 until spring 39 hits up against end wall 26 of main body section 15 until its abuts up against step 50. Then, insulator 31 is placed on other end 31-2 of pin 31. Then, second connector 27 is slid into insulator 35. Then, second connector 27 is pushed into main body section 15. As can be seen, spring 39 is sized so that once it is inserted into main body section 15 and second connector 27 is slid onto main body section 15, spring 39 cannot move longitudinally within main body section 15. Thus, GDT 37 will remain stationary within main body section 15.

As an example, the inside diameter D1 of main body section 15 is 0.645 inches, the outside diameter D2 of pin 31 is 0.078 inches and the inside diameter D3 of each one of connectors 21 and 27 is 0.27 inches.

Figure 1A:
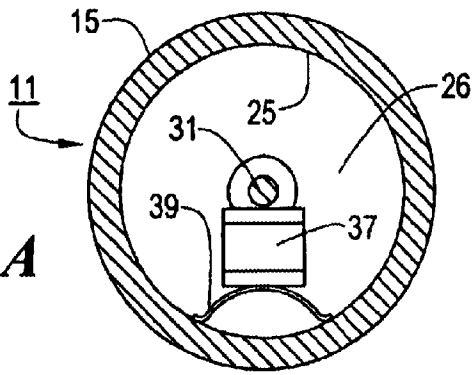
FIG. 1A is a section view taken along lines 1A—1A in FIG. 1.
Figure 6A:
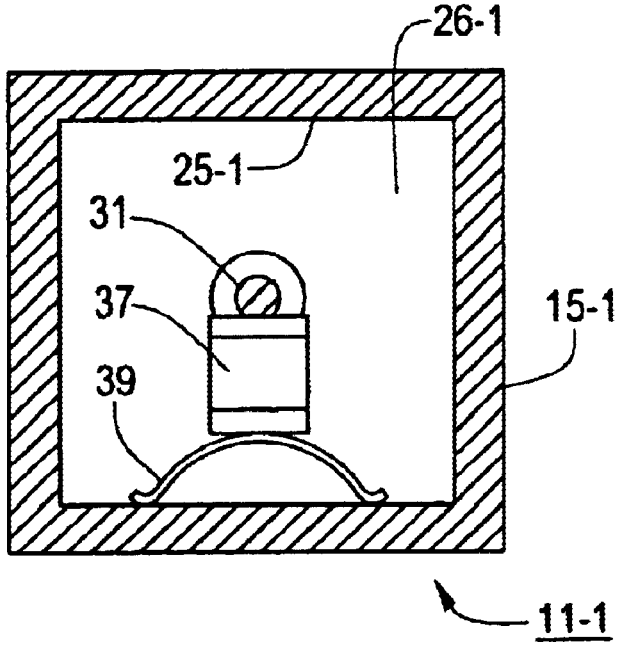
FIG. 6A is a lateral section view of a modification of the protective device shown in FIG. 1.

Instead of being cylindrically shaped, i.e. circular in lateral cross-section as can be seen in FIG. 1A, the main body section of the outer conductor could have other lateral cross-sectional shapes such as rectangular or hexagonal. In FIG. 6A there is shown such a modification where the main body section, identified by reference numeral 15-1, is rectangular in cross-section, the inner sidewall is identified by reference numeral 25-1 and the inner end wall is identified by reference numeral 26-1. Except for the shape of the main body section, device 11-1 is identical to device 11.

Figure 7:
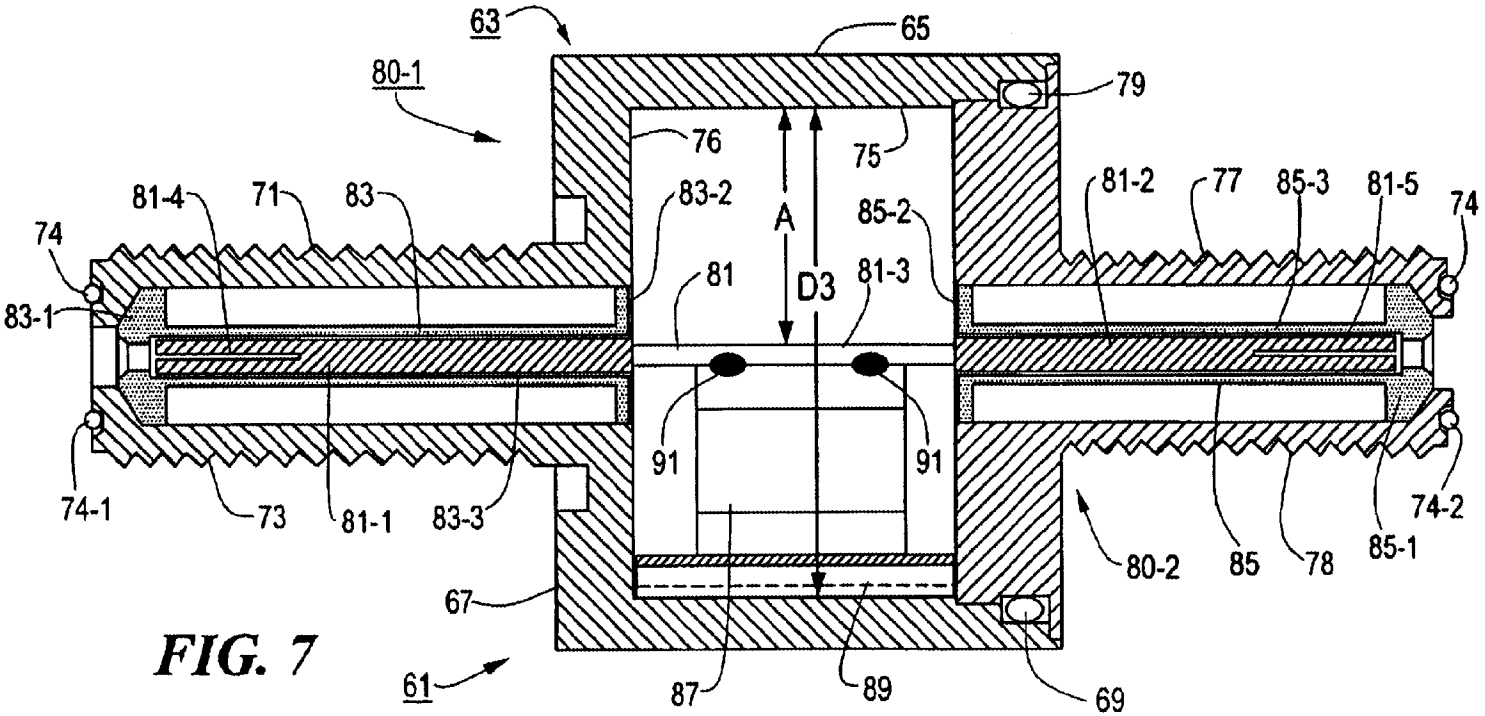
FIG. 7 is a section view of a second embodiment of a protective device constructed according to this invention.
Figure 8:
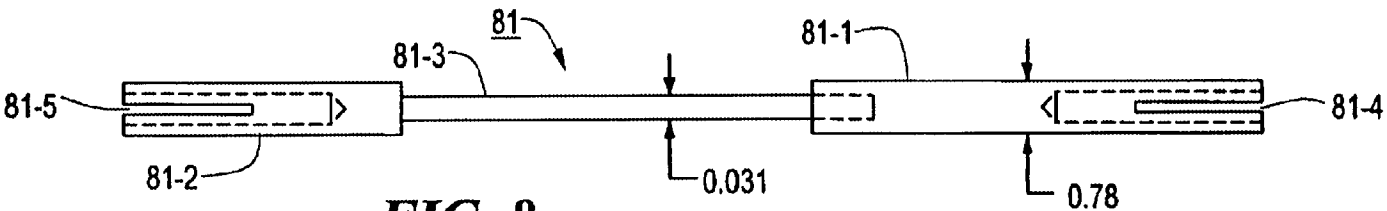
FIG. 8 is a side view of the inner conductor in the protective device in FIG. 7.
Figure 9A:
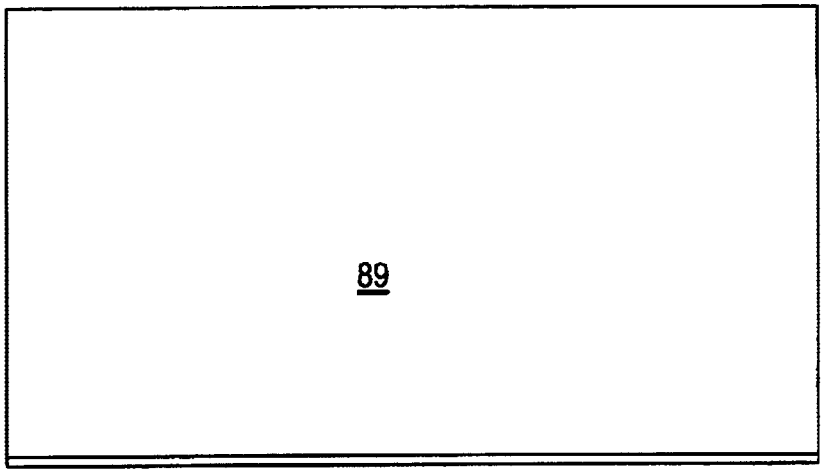
FIGS. 9A, 9B and 9C are plan, end and side views, respectively, of the spring shown in FIG. 7.
Figure 9B:
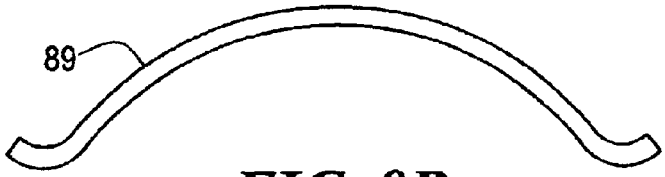
Figure 9C:
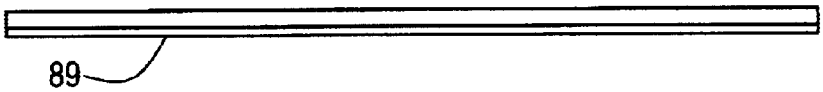

Referring now to FIG. 7, there is shown a second embodiment of a protective device constructed according to this invention and identified by reference numeral 61.

Protective device 61 comprises an outer conductor 63 having a main body section 65 which includes a first end 67 and a second end 69. Outer conductor 63 further includes a first connector 71. First connector 71 is an elongated generally cylindrically shaped member which is threaded on its outer surface 73 and is integrally formed with main body section 65. An end gasket 74 is seated in a recess 74-1 at the outer end of first connector 71. Outer conductor 63 is made of a suitable conductive material such as brass. Main body section 65 is in the general form of a cylindrical housing open at one end and has an inner sidewall 75 that is cylindrically shaped and an inner end wall 76 that is annularly shaped. Outer conductor 63 further includes a second connector 77. Second connector 77, which constitutes an end plug, is press fit onto second end 69 of main body section 65. Second connector 77 includes an elongated generally cylindrically shaped member which is threaded on its outer surface 78. Second connector 77 is made of a suitable conductive material such as brass. An O-ring 79 is sandwiched between main body section 65 and end plug 77 and an end gasket 74 is seated in a recess 74-2 at the outer end of connector 77.

Main body section 65 and first connector 71 together define the primary portion 80-1 of outer conductor 63 while second connector 77 defines the secondary portion 80-2 of outer conductor 63.

An inner conductor 81 is axially disposed within outer conductor 63 and extends through main body section into first connector 71 and into second connector 77. Inner conductor 81 is in the form of an elongated pin having a pair of end sections 81-1 and 81-2 of one cross-sectional diameter and a center section 81-3 having a cross-sectional diameter less than that of end sections 81-1 and 81-2. Pin 81 is slotted at each end 81-4 and 81-5 so that it can receive a pin from a mating male connector (not shown) to which it may be connected. Inner conductor 81 is made of a bronze alloy i.e. copper alloy 510, or other suitable conductive material.

As can be seen, first and second connectors 71 and 77 are constructed as female connector interfaces; i.e. constructed to receive mating male connectors.

A pair of spool shaped insulators 83 and 85, one insulator 83 being inside first connector 71 and the other insulator 85 being inside second connector 77 mechanically support pin 81 and electrically insulate pin 81 from outer conductor 63. Insulators 83 and 85 may be made of polycarbonate or other suitable insulative material. Insulator 83 comprises a pair of disc shaped end sections 83-2 disposed on either end of an elongated center section 83-3. Insulator 85 comprises a pair of disc shaped end sections 85-1 and 85-2 disposed on either end of an elongated center section 83-5. As can be seen, insulators 83 and 85 are long in that they extend along the entire length of connectors 71 and 77, respectively. In this way, insulator 83 provides support for pin 81 over the entire length of end section 81-1 and insulator 85 provides support for pin 81 over the entire length of end section 81-2. This reduces any bowing that might occur within center sections 81-3 because of its reduced diameter.

It should be noted that the insulator in addition to supporting the pin, is used to control the impedance of the pin. The impedance of the pin over the length 81-1 is controlled to be less than the characteristic impedance of the mating coaxial cable (which is typically 50 Ohms or 75 Ohms). This is accomplished by making the ID of connector 71 and the OD of pin 81-1 such that the impedance of this length of transmission line is approximately equal to the characteristic impedance, and adding insulator material to insulator 83 in the region between 71 and 81-1 to reduce the net impedance to a lower value. The manipulation of impedance in the insulators and/or the connectors along with adjusting the internal dimensions of the main body produces a structure which starts off with an impedance of about 80% to 90% of the cable characteristic impedance in one connector, then an increase in impedance (approximately 200% to 250% of the cable characteristic impedance), in the main body, and then through a length of lower impedance (again about 89% to 90% of the cable characteristic impedance) in the other connector, and then to the cable (not shown). These impedance control and compensate for the effects of GDT 87, and improve higher frequency RF performance, particularly above 2 Ghz.

A protective element in the form of a gas discharge tube (GDT) 87 is disposed inside main body section 65 between inner sidewall 75 and pin 81. GDT 87 may be, for example, Part Number BB90 made by CITEL.

A spring 89 of electrically conductive material is disposed inside main body section 65 between GDT 87 and main body section 65 in contact with sidewall 75 and GDT 87 and under compression. Spring 89 differs from spring 39 in that it does not include any tabs. As can be appreciated, GDT 87 and spring 89 provide a current path from pin 81 to sidewall 75. In addition, spring 89 serves to maintain GDT 87 in fixed position within main body section 65. Spring 89 is mechanically and electrically connected to GDT 87 by solder 91. In addition to securing GDT 87 to pin 81, solder 91 increases the area of electrical contact between GDT 87 and pin 81.

Protective device 61 is assembled in a similar way as protective device 11, the difference being that the GDT is soldered to the pin rather than being mechanically attached to the pin through tabs on the spring as is the case with device 11.

As noted above, outer conductor 63 is identical in size and shape to outer conductor 13. However, because center portion 81-3 of pin 81 is thinner than the corresponding portion in pin 31, the ratio of distance A from pin 81 to sidewall 75 to pin diameter (0.031) is greater than the ratio of the distance B from pin 31 to sidewall 25 to pin diameter (0.078). This increases the RF properties of device 61 relative to device 11. Instead of decreasing the cross-sectional diameter of the center portion of the pin, the pin could be kept uniform in cross-sectional diameter as with pin 31 and the main body section of the outer conductor made larger in cross sectional diameter.

As an example, the inside diameter D3 of main body section 65 is 0.645 inches and the outside diameter D4 of center section 81-3 of pin 81 is 0.031 inches.

Figure 10:
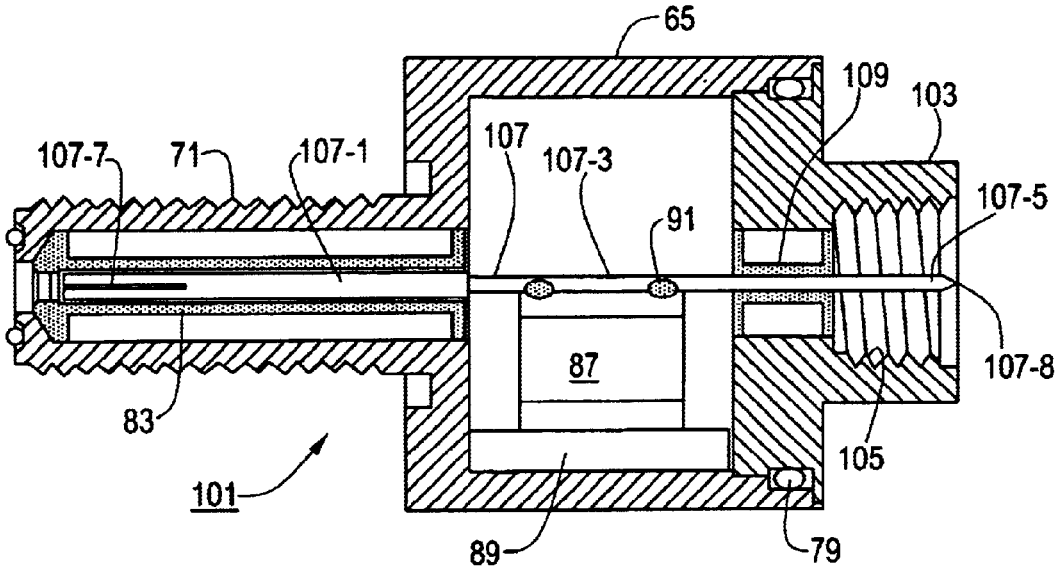
FIG. 10 is a section view of a third embodiment of a protective device constructed according to this invention.

Referring now to FIG. 10 there is shown a third embodiment of a coaxial protective device constructed according to this invention and identified by reference numeral 101.

Protective device 101 is similar to coaxial protective 61 in that it includes a main body section 65 integrally formed with a first connector 71, a GDT 87 and a spring 89 all arranged in the same manner as in protective device 61. However, instead of a second connector being constructed as a female connector interface as in coaxial protective device 61, second connector 103 in coaxial protective device 101 is constructed as a male connector interface and accordingly is threaded on its inner surface 105. In addition, the pin and the insulator supporting the pin within the second connector end in protective device 101 are different from the corresponding part in coaxial protective device 61. More specifically, in coaxial protective device 101, pin 107 has a left section 107-1 with slots 107-6 at its outer end 107-7 so that it can receive a male pin, a center section 107-3 and a right section 107-5 having a tip 107-8 shaped to penetrate a female pin. Center section 107-3 has a cross-sectional diameter less than left section 107-1 and right section 107-5 that is smaller in cross-sectional diameter than center section 107-3. Pin 107 is supported within connector 103 by an insulator 109. Insulator 109 is shorter than insulator 85 to conform to the construction of male connector interface 103. GDT 87 is attached to pin 107 with solder 91.

Device 101 is assembled in a manner similar to the assembly arrangement for device 61.

Figure 11:
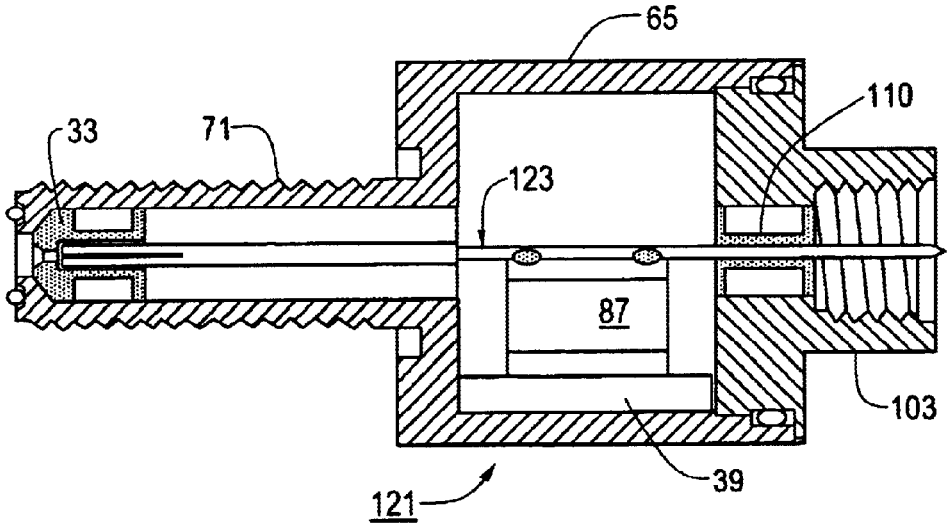
FIG. 11 is a section view of a fourth embodiment of a protective device constructed according to this invention.

Referring now to FIG. 11 there is shown a fourth embodiment of a protective device constructed according to this invention and identified by reference numeral 121.

Protective device 121 includes a main body section 65 integrally formed with a first connector 71, a second connector 103, an insulator 33, an insulator 110, a protective device in the form of a GDT 87, a spring 39 and a pin 123. Pin 123 has a left section 123-1, a center section 123-3 and a right section 123-5. Center section 123-3 and left section 123-1 have a cross sectional diameter less than that of right section. Device 121 is assembled in a manner similar to the assembly arrangement for device 11.

As can be appreciated, the protective devices disclosed in the four embodiments described above are all coaxial type devices.

Figure 12A:
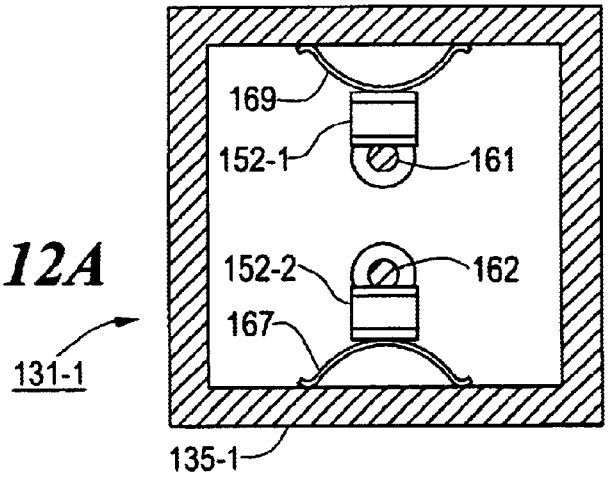
FIG. 12A is a lateral section view of a modification of the protective device shown in FIG. 12.
Figure 12:
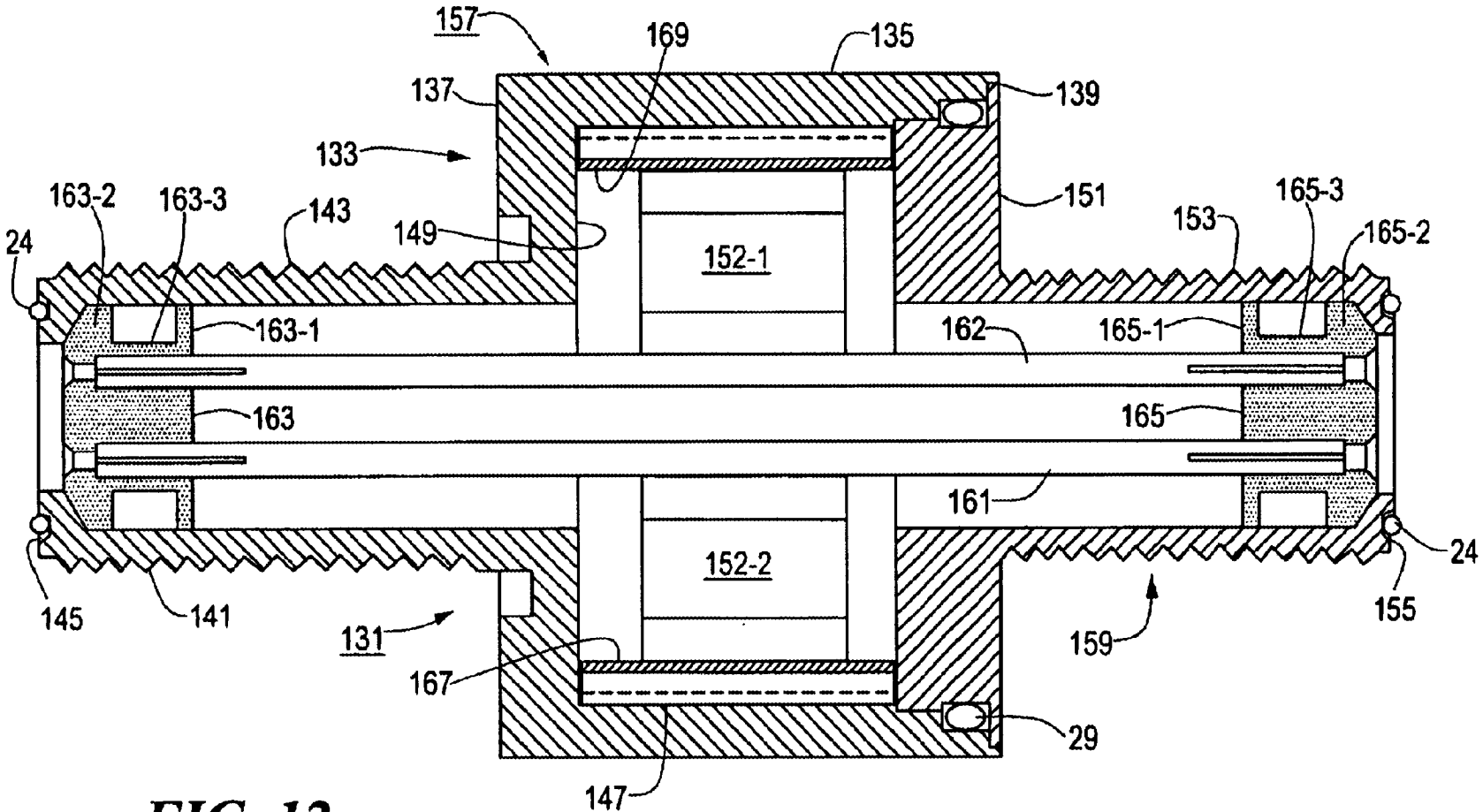
FIG. 12 is a section view of a fifth embodiment of a protective device constructed according to this invention.

Referring now to the drawings, there is shown in FIG. 12 another protective device constructed according to the teachings of the present invention, the protective device being identified by reference numeral 131.

Protective device 131 differs from the protective devices disclosed in FIGS. 1–11 in that it is not coaxial. Protective device 131 comprises an outer conductor 133 having a main body section 135 which includes a first end 137 and a second end 139. Outer conductor 133 further includes a first connector 141. First connector 141 is an elongated generally cylindrically shaped member which is threaded on its outer surface 143 and is integrally formed with main body section 135. A gasket 24 is seated in a recess 145 at the outer end of first connector 141. Outer conductor 133 is made of a suitable conductive material such as brass. Main body section 135 is in the general form of a cylindrical housing open at end 139 and has an inner sidewall 147 that is cylindrically shaped and an inner end wall 149 that is annularly shaped. Outer conductor 133 further includes a second connector 151. Second connector 151, which constitutes an end plug, is press fit onto second end 139 of main body section 135. Second connector 151 includes an elongated generally cylindrically shaped member which is threaded on its outer surface 153. Second connector 151 is made of a suitable conductive material such as brass. An O-ring 29 is sandwiched between main body section 135 and end plug 151. Another gasket 24 is seated in recess 155 at the outer end of second connector 151.

Main body section 135 and first connector 141 together define the primary portion 157 of outer conductor 133 while second connector 151 defines the secondary portion 159 of outer conductor 133.

A pair of inner conductors 161 and 162, identical to pin 31 are disposed within outer conductor 133 and extend through main body section 135 into first connector 141 and into second connector 151.

As can be seen, first and second connectors 143 and 151 are constructed as female connector interfaces; i.e. constructed to receive mating male connectors.

A pair of spool shaped insulators 163 and 165, one insulator 163 being inside first connector 141 near its outer end and the other insulator 165 being inside second connector 151 near its outer end, mechanically support pins 157 and 159 and electrically insulate pins 157 and 159 from outer conductor 13. Insulators 163 and 165 may be made of polycarbonate or other suitable insulative material. Insulator 163 comprises a pair of disc shaped end sections 163-1 and 163-2 disposed on either end of an elongated center section 163-3. Insulator 165 comprises a pair of disc shaped end sections 165-1 and 165-2 disposed on either end of an elongated center section 165-3. As can be seen, insulators 163 and 165 are short in that they extend only partially along the length of connectors 141 and 151, respectively rather than along the entire length of their respective connectors.

A pair of GDT's, namely GDT 152-1 and 152-2, identical to GDT 37 are disposed inside main body section 135, GDT 152-1 being between inner sidewall 147 and pin 161 and GDT 152-2 being between inner sidewall 147 and pin 162.

A pair of springs 167 and 169 of electrically conductive material which are identical to spring 39 are disposed inside main body section 135. Spring 167 being between one GDT 152-1 and sidewall 147 and spring 169 being between GDT 152-2 and sidewall 147. Spring 167 is mechanically attached to GDT 152-1 by a pair of tabs 41 and 43, (not shown), which extend out from body portion of spring 167 and engage a depression on the bottom of GDT 152-1. Spring 169 is attached to GDT 152-2 in a similar manner.

Instead of being cylindrically shaped, the main body section of the outer conductor shown in FIG. 12 could have other cross-sectional shapes such as rectangular or hexagonal such as shown in FIG. 12A. In device 131-1 shown in FIG. 12A, main body section 135-1 is rectangular in cross section. Except for the shape of main body section 135-1, device 131-1 is identical to device 135.

The embodiments shown in the present invention are intended to be merely exemplary and those skilled in the art shall be able to make numerous variations and modifications to them without departing from the spirit of the present invention. All such variations and modifications are intended to be within the scope of the present invention as defined in the appended claims.

What is claimed is:

1. A protective device for deflecting or reducing short duration, large current electromagnetic impulses traveling along an RF cable while allowing desired RF signals to pass through comprising:

(a) an outer conductor, said outer conductor comprising a main body section, a first connector and a second connector, said main body section having a first end and a second end, said first connector extending out from the first end of the main body section, said main body section being in the form of a housing having an inner sidewall that is cylindrically shaped, said second connector extending out from the second end of the main body section, (b) an inner conductor axially disposed within the outer conductor and extending through said main body section into said first and second connectors, (c) insulators for mechanically supporting and electrically insulating the inner conductor from the outer conductor, (d) protective element disposed inside the main body section between the inner sidewall in the main body section and the inner conductor, and (e) a spring of electrically conductive material disposed inside the main body section between the inner sidewall and the protective element, said spring being in contact with said inner side wall of said housing and said protective element and being under compression.

2. The protective device of claim 1 wherein said first connector comprises a female connector.

3. The protective device of claim 2 wherein said second connector comprises a female connector.

4. The protective device of claim 3 wherein said inner conductor comprises an elongated pin.

5. The protective device of claim 4 wherein said elongated pin is uniform in cross-sectional diameter throughout its length.

6. The protective device of claim 5 wherein there are two insulators, one at each end of the pin.

7. The protective device of claim 6 wherein the insulators are spool shaped.

8. The protective device of claim 7 wherein the protective element is a GDT, and wherein the GDT is mechanically coupled to the spring.

9. The protective device of claim 4 wherein said elongated pin has a pair of outer sections and a center section and wherein said center section has a smaller cross-sectional diameter than the two outer sections.

10. The protective device of claim 9 wherein said insulators comprise two insulators, each extending the length of one of the outer sections.

11. The protective device of claim 9 wherein said insulators comprise two spool shaped insulators and two disc shaped insulators.

12. The protective device of claim 2 wherein said second connector comprises a male connector.

13. The protective device of claim 2 wherein said second connector is a male connector.

14. The protective device of claim 2 wherein said inner conductor is an elongated pin having a center section and a pair of outer sections, the center section having a smaller cross-sectional diameter than the outer sections and the second connector comprising a male connector.

15. The protective device of claim 1 wherein said protective element is a GDT and wherein said GDT is soldered to said inner conductor and mechanically attached to said spring.

16. The protective device of claim 1 wherein the insulators are tuned to improve RF performance.

17. A protective device for deflecting or reducing short duration, large electromagnetic impulses traveling along an RF cable while allowing desired RF signals to pass through comprising:

(a) an outer conductor, said outer conductor comprising a main body section, a first connector and a second connector, said main body section having a first end and a second end, said first connector extending out from the first of the main body section, said main body section being in the form of a housing having an inner sidewall, said second connector extending out from the second end of the main body section, (b) a pair of inner conductors disposed within the outer conductor and extending through said main body section into said first and second connectors, (c) insulators for mechanically supporting and electrically insulating the pair of inner conductors fro the outer conductor, (d) a pair of protective elements disposed inside the main body section between the inner sidewall in the main body section and the inner conductor, and (e) a pair of springs of electrically conductive material disposed inside the main body section each between the inner sidewall and one of the protective elements, each spring being in contact with said inner sidewall and one of said protective elements and being under compression.

18. A protective device for deflecting or reducing short duration, large current electromagnetic impulses traveling along an RF cable while allowing desired signals to pass through comprising:

(a) an outer conductor, (b) an inner conductor, (c) at least one insulator for mechanically supporting and electrically insulating the inner conductor from the outer conductor, (d) a protective element, and (e) a spring of conductive material, (f) the protective element being disposed between the inner conductor and the spring, and (g) the spring being disposed between the protective element and the inner sidewall of the outer conductor and being under compression.

19. A protective device for deflecting or reducing short duration, large current electromagnetic impulses traveling along an RF cable while allowing desired signals to pass through comprising:

(a) an outer conductor having a main body section and connecting interfaces at opposite ends of the main body section, said main body section having an inner sidewall that is cylindrically shaped, (b) an inner conductor, (c) at least one insulator for mechanically supporting and electrically insulating the inner conductor from the outer conductor, and (d) a protective element, (e) the protective element being disposed between the inner conductor and the outer conductor, in contact with said inner sidewall of said outer conductor, (f) wherein the RF transmission impedance of the connecting interfaces are lower than the RF cable characteristic impedance and the RF impedance of the main body is greater than the characteristic impedance of the RF cable.

20. The protective device of claim 18 wherein said spring, together with the protective device, provides a current path from the inner conductor to the outer conductor.

21. The protective device of claim 8 wherein said protective element is mechanically coupled to the spring by a tab on the spring.

22. A protective device for deflecting or reducing short duration, large current electromagnetic impulses traveling along a RF cable while allowing desired RF signals to pass through comprising:

(a) an outer conductor, said outer conductor comprising a main body section, a first connector and a second connector, said first connector comprising a female connector, said second connector comprising a female connector, said main body section having a first end and a second end, said first connector extending out from the first end of the main body section, said main body section being in the form of a housing having an inner sidewall, said second connector extending out form the second end of the main body section, (b) an inner conductor axially disposed within the outer conductor and extending through said main body section into said first and second connectors, said inner conductor comprising an elongated pin uniform in cross-sectional diameter throughout its length, (c) a pair of spool shaped insulators for mechanically supporting and electrically insulating the inner conductor from the outer conductor, one at each end of said elongated pin, (d) a protective element disposed inside the main body section between the inner sidewall in the main body section and the inner conductor, (e) a spring of electrically conductive material disposed inside the main body section between the inner sidewall and the protective element, (f) said protective element being a GDT and being mechanically coupled to the spring, and (g) an o-ring between the second connector and the main body section.

23. A protective device for deflecting or reducing short duration large current electromagnetic impulses traveling along an RF transmission line while allowing the desired signals to pass through comprising:

(a) an outer conductor having a main body section and connecting interfaces at each end at opposite ends of the main body section, (b) where the interfaces defines a nominal impedance by the diameter of the inner conductor and outer conductor and the interposed dielectric material, (c) an inner conductor, (d) at least one insulator for mechanically supporting and electrically insulating the inner conductor from the outer conductor, (e) protective element connected from the inner conductor to the outer conductor, (f) a length of inner conductor within the main body section with a length of higher than nominal transmission line impedance where the protective element is connected to the inner conductor, (g) a length of inner conductor between the higher than nominal impedance length and an interface that has a lower impedance than the nominal transmission line impedance.

24. A protective device according to claim 23 where the protector has two lengths center conductor with lower than nominal impedance on each both ends between the higher impedance inner conductor length, where the protective component connects to the inner conductor.

25. A protective device according to claim 23 where the lower impedance lengths are formed by sue of additional high dielectric constant material between the inner and outer conductor.

26. A protective device according to claim 23 where the impedances are formed by changing the inner conductor diameter, the inside diameter of the outer conductor, and the interposed dielectric material.

* * * * *